United States Patent [19]

Daver

[11] 4,015,947

[45] Apr. 5, 1977

[54] PRODUCTION OF SINTERED ALUMINUM ALLOY ARTICLES FROM PARTICULATE PREMIXES

[75] Inventor: Edul M. Daver, Westfield, N.J.

[73] Assignee: Alcan Aluminum Corporation, Cleveland, Ohio

[22] Filed: Sept. 10, 1975

[21] Appl. No.: 611,888

[52] U.S. Cl. ..... 75/201; 75/170; 75/171; 75/176; 75/228

[51] Int. Cl.[2] ..... B22F 3/00; C23C 1/04

[58] Field of Search ..... 75/170, 171, 176, 201; 29/182

[56] References Cited

UNITED STATES PATENTS

| | | | |
|---|---|---|---|
| 3,180,012 | 4/1965 | Smith | 75/170 |
| 3,361,560 | 1/1968 | Severns, Jr. et al. | 75/176 |
| 3,410,732 | 11/1968 | Smith | 75/171 |
| 3,781,170 | 12/1973 | Nakao et al. | 75/201 |
| 3,865,586 | 2/1975 | Volin et al. | 75/201 |

*Primary Examiner*—Brooks H. Hunt
*Attorney, Agent, or Firm*—Cooper, Dunham, Clark, Griffin & Moran

[57] ABSTRACT

A method of making aluminum alloy parts having high wear resistance, comprising incorporating, in an aluminum premix powder, a minor proportion of particles of an additive alloy of cobalt or nickel containing a relative hard Laves phase intermetallic in a relatively soft matrix, and sintering the resultant mixture under conditions for effecting controlled diffusion of the additive alloy. The premix powder may be a mixture of a major proportion of aluminum with a minor proportion of one or more alloying elements; in particular, the premix may contain a minor proportion of magnesium. To achieve properly limited diffusion, the sintering step is performed at a temperature lower than that employed to sinter the premix powder when the additive alloy is not present.

20 Claims, 3 Drawing Figures

PRODUCTION OF SINTERED ALUMINUM ALLOY ARTICLES FROM PARTICULATE PREMIXES

BACKGROUND OF THE INVENTION

This invention relates to aluminum powder metallurgy, and more particularly to methods of making sintered aluminum alloy particles having improved wear resistance from mixtures of aluminum and other metal powder or particles, as well as to the products of such methods.

In the production of an aluminum alloy article by powder metallurgical techniques as heretofore known, an aluminum premix powder (typically containing a major proportion of aluminum and a minor proportion of one or more alloying elements having high solubility with aluminum) is sintered, commonly after being compacted in the presence of a lubricant. In most instances, the premix is compacted in admixture with a lubricant, and sintering is effected in a dry non-oxidizing atmosphere, at a temperature which is above the solidus point of the alloy to ensure rupturing of oxide surface films on the metal particles as necessary for bonding. Alternatively, the premix may be very highly compacted (to at least 95% of theoretical density) without admixed lubricant, but with lubrication of the walls of the compacting die, and then sintered in air; the high degree of compaction, in such case, seals the surface of the compacted body before and during sintering, effectively providing a low dew point atmosphere within the body. A typical range of sintering temperatures, for present-day conventional aluminum premixes, is between about 590° and 635° C.

Among articles that may be produced in this way are bearings, face seals, thrust washers and others parts subject to wear and friction in use. While aluminum alloys offer various advantages, including light weight, stated in general it would be desirable to improve the wear resistance of such articles, e.g. at elevated temperatures.

There has been developed a class of intermetallic materials, which are cobalt or nickel-based alloys (containing molybdenum or tungsten as a principal alloying element together with silicon and, optionally, chromium) having a hard so-called Laves phase intermetallic present in a soft matrix, characterized by superior high-temperature wear resistance as well as by good corrosion resistance. Alloys of this general character are described, for example, in U.S. Pat. Nos. 3,180,012; 3,361,560; and 3,410,732. Specific compositions of this class are commercially available under the trade name "Tribaloy." It has been found that alloys of the described class, when incorporated in powdered or particulate form as an additive in a premix powder containing a major proportion of other metal powder such as iron, stainless steel, nickel or bronze, can impart properties of significantly improved wear resistance to articles produced by sintering the premix. Heretofore, however, it has not been possible to produce satisfactory sintered parts from aluminum premix powders containing such additive, because the inclusion of the additive resulted in weak, distorted, discolored articles.

SUMMARY OF THE INVENTION

The present invention broadly embraces the discovery that aluminum alloy articles having superior wear resistance as well as other advantageous properties may be produced by sintering an aluminum premix powder containing a minor proportion of a particulate additive alloy of the class described above, under controlled conditions such as to effect limited diffusion of the additive alloy. Specifically, and surprisingly in relation to prior experience in aluminum powder metallurgy, this result is achieved by sintering the mixture at a temperature lower than that conventionally employed for sintering aluminum premixes.

That is to say, whereas use of sintering temperatures within the conventional range is necessary to achieve the requisite bonding and to develop adequate strength, and notwithstanding that additive alloys of the class defined melt at even much higher temperatures, applicant has discovered that the sintering of mixtures of a major proportion of aluminum premix powder and a minor proportion of such additive should be performed at temperatures between about 530° C and about 590° C, and preferably at temperatures between about 550° C and about 580° C. With this special temperature condition observed, the time and other conditions of sintering may be the same as in conventional sintering of aluminum premixes.

In this broad sense, the present invention contemplates intimately mixing a major proportion of aluminum premix powder with a minor proportion of a particulate additive which is an alloy of cobalt or nickel having a hard intermetallic Laves phase present in a softer matrix, the proportion of additive being such as to impart wear resistance to a sintered article; sintering the mixture at a temperature of about 530° to about 590° C for producing a structurally integral sintered article; and allowing the resultant article to cool. The product of this method is an article having fully adequate strength for many applications, and good wear resistance, and is free from objectionable distortion or discoloration.

It is now believed that the attainment of these desired results is attributable to the extent of diffusion of the additive alloy during sintering. If there is little or no diffusion, there is poor bond formation between the particles of the mixture being sintered, and the mechanical properties of the resultant sintered article are unacceptable. Excessive diffusion, on the other hand, leads to loss of strength, distortion of the sintered article, and substantial disappearance of the hard, wear-resistant bodies of the additive. Thus, diffusion must be sufficient to achieve good mechanical properties while retaining hard intermetallic cores to provide wear resistance. The stated sintering temperature range of the present invention affords this desired degree of controlled or limited diffusion.

The aluminum premixes employed in the preferred practice of the invention are mixtures, in powdered form, of a major proportion of aluminum and a minor proportion of at least one alloying element having high solubility with aluminum. The alloying element or elements aid both in activating sintering and in widening the temperatures ranges for practical sintering. In an important specific aspect, the invention particularly contemplates the use of aluminum premixes containing a minor proportion (optimally between about 0.5 and about 2.0% by weight) of magnesium, with or without additional alloying elements present, the presence of magensium being found to provide advantageous strength in the sintered product.

Further features and advantages of the invention will be apparent from the detailed description hereinbelow set forth, together with the accompanying drawing.

DETAILED DESCRIPTION

Figure 1:
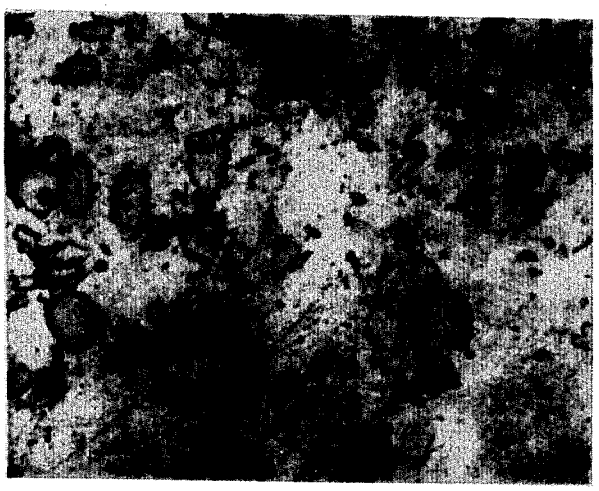
FIG. 1 is a photomicrograph (magnification 200 x) of a mixture of an aluminum premix powder and "Tribaloy" intermetallic additive in under-sintered condition.

For purposes of illustration, the invention will be described as embodied in procedures for producing a sintered aluminum alloy article such as a bearing from an aluminum premix powder comprising a major porportion (typically at least about 90% by weight) of aluminum metal powder, and at least about 1% by weight of alloying element or elements whereof at least one has high solubility with aluminum. In a specific sense, the invention contemplates use of such premixes wherein magnesium is present as an alloying element, with or without additional alloying elements; the preferred range of magnesium content is between about 0.5 and about 2.5% (optimally about 0.5 – 2.0%) by weight. An exemplary group of such premixes, suitable for the practice of the present invention, are mixtures of metal powder consisting essentially of about 0.25 to about 4.4% Cu, about 0.5 to about 2.5% Mg, up to about 0.9% Si, up to about 0.4% Mn, up to about 0.2% Cr, up to about 5.6% Zn, and about 90.1 to about 98.05% Al (all percentages being by weight). Specific commercially available examples of such premixes are as follows:

| Commercial Designation | Percent by Weight | | | | | | |
|---|---|---|---|---|---|---|---|
| | Al | Cu | Mg | Si | Mn | Cr | Zn |
| MD 22 | 96.7 | 2.0 | 1.0 | 0.3 | — | — | — |
| MD 24 | 93.8 | 4.4 | 0.5 | 0.9 | 0.4 | — | — |
| MD 69 | 98.05 | 0.25 | 1.0 | 0.6 | — | 0.1 | — |
| MD 76 | 90.1 | 1.6 | 2.5 | — | — | 0.2 | 5.6 |

The foregoing premixes are mixtures of elemental powders but prealloyed particles may also be used. Typically, the particles of the premix are of –60 mesh particle size, whereof about 35% are of –325 mesh particle size. In most cases, a lubricant is incorporated in these premixes, e.g. in an amount of 1.5 parts by weight of lubricant per 100 parts by weight of premix.

In accordance with the invention, there is mixed, with a major proportion of an aluminum premix powder as defined above, a minor proportion of particles of an alloy of cobalt or nickel containing a hard Laves phase intermetallic in a softer matrix. This latter alloy, referred to herein as an additive, is termed a cobalt or nickel alloy because the metal present in the largest proportion by weight therein is cobalt or nickel. In a specific sense, such additive alloy may be an alloy consisting essentially of a first metal selected from the class consisting of cobalt and nickel; a second metal selected from the class consisting of molybdenum and tungsten; a minor proportion of silicon; and, optionally, a minor proportion of chromium; wherein the amount of the first metal present exceeds the amount if any other alloying element present, in parts by weight. Preferably, this additive alloy is added to the aluminum premix in sufficient quantity to constitute between about 5% and about 25% by volume (indeed very preferably between about 10% and about 20% by volume) of the premix-additive mixture.

Alloys found particularly suitable as the additive in the present invention are those consisting essentially of about 50 to about 62% by weight Co or Ni; about 28 to about 35% by weight Mo; about 2 to about 10% by weight Si; and up to about 17% by weight Cr; and having a ternary or quaternary intermetallic Laves phase of the C14 type present in a proportion of about 30 to about 65% by volume, in a matrix which is softer than the Laves phase. Examples of such alloys, commercially available under the trade name "Tribaloy" from Du Pont Tribaloy Products, are as follows:

| Commercial Designation | % by weight | | | | | Laves Phase (% by Vol.) |
|---|---|---|---|---|---|---|
| | Co | Ni | Mo | Si | Cr | |
| Tribaloy 100 | 55 | — | 35 | 10 | — | 65 |
| Tribaloy 400 | 62 | — | 28 | 2 | 8 | 35 |
| Tribaloy 700 | — | 50 | 32 | 3 | 15 | 30 |
| Tribaloy 800 | 52 | — | 28 | 3 | 17 | 45 |

These "Tribaloy" alloys are available in the form of –200 mesh size prealloyed powder, and in that form are suitable for direct incorporation in an aluminum premix powder.

In a typical instance of the practice of the present invention, an aluminum premix powder and particulate additive alloy as defined above, in the stated relative proportions, are physically intimately mixed to achieve substantially uniform distribution of the additive particles through the premix. The mixture, with a minor proportion of a lubricant present, is then compacted to the desired shape of the article to be produced, e.g. by application of pressure sufficient to form a compacted body of about 95% of theoretical density. Thereafter, the compacted body is sintered, in a dry non-oxidizing atmosphere (such as a dry $N_2$ atmosphere, with a dew point of –40° F or lower) for a period of time (e.g. about 15 to about 60 minutes, typically about 30 minutes), sufficient to produce a strong, sintered article. The sintered product is then allowed to cool.

Alternatively, the mixture of premix and additive may be compacted without incorporated lubricant (but with lubricant present on the walls of the compacting die) to at least 95% of theoretical density, and sintered in ordinary air; the high degree of compaction seals the surface of the compacted body, before and during sintering, so that there is effectively a sufficiently low dew point atmosphere within the body to enable effective sintering. As a further alternative, the mixture of premix and additive may be compacted to a lower density (e.g. about 85% of theoretical density) and sintered in a dry non-oxidizing atmosphere, to produce a porous, oil-impregnable sintered article as desired for various purposes.

Further in accordance with the invention, and as a particular feature thereof, the sintering step (in the case of each of the above-mentioned procedures, using mixtures of aluminum premix powder with the additive as defined above) is performed at a temperature between about 530° and about 590° C. The preferred sintering temperature range, for development of optimum properties, it between about 550° and 570° C. These sintering temperatures are substantially below the temperatures at which the same premixes are sintered when the additive is not present. It is found that, whereas the product obtained by sintering a mixture of aluminum premix and the above-defined additive is unacceptably weak, distorted and discolored when sintered at a temperature conventionally used for development of optimum properties in a body constituted of the premix alone, sintering the premix-additive mixture results in a highly satisfactory product if performed at a significantly lower temperature.

Thus, for example, the above-defined aluminum premix commercially designated MD-22 is conventionally sintered at about 625° C for development of optimum properties, but when 10–20 vol.% "Tribaloy 400" alloy is incorporated therein, optimum properties are developed at a sintering temperature of about 560° C, while sintering a 625° C results in an unacceptable product.

Figure 2:
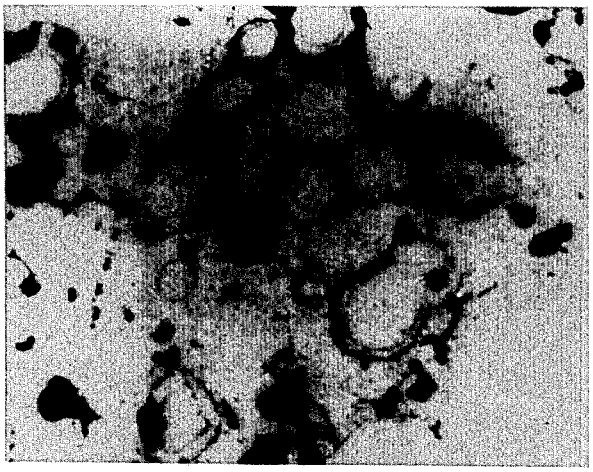
FIG. 2 is a photomicrograph (magnification 200 x) of a mixture as in FIG. 1, but properly sintered in accordance with the present invention.
Figure 3:
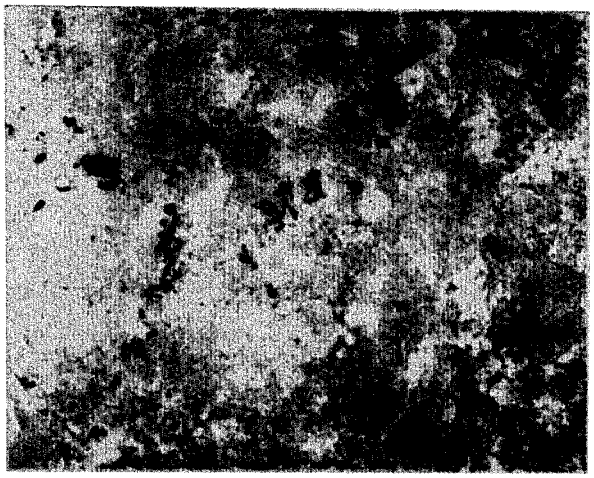
FIG. 3 is a photomicrograph (magnification 400 x) of a mixture as in FIG. 1, in over-sintered condition.

In this connection, it may be explained that development of satisfactory properties, in a sintered article produced from a mixture of an aluminum premix and the particulate additive, is related to the extent of diffusion of the additive particles achieved during sintering. Referring to the figures, which are photomicrographs of sintered articles produced from aluminum premixes containing 10% by volume "Tribaloy" intermetallic additive, if the material is "under"-sintered, the additive particles as viewed micrographically (FIG. 1) appear virtually unchanged, and insufficient bonding occurs to develop adequate mechanical properties. If the material is "over"-sintered, the additive particles are virtually indiscernable micrographically (FIG. 3), i.e. they are no longer present as discrete bodies, and again inferior properties result, as well as failure to achieve desired wear resistance. The proper degree of diffusion is that at which the additive particles remain clearly identifiable micrographically as discrete bodies, yet are surrounded by an annular layer or region of diffusion, as shown in FIG. 2, which illustrates a product produced in accordance with the present invention. This proper degree of diffusion is achieved by the special sintering temperature conditions of the invention.

The articles produced by the present process are characterized by an advantageous combination of properties including light weight, good conductivity, good dampening, embeddability, and superior wear resistance. They are non-magnetic and comparatively low in cost. Accordingly, they are highly suitable for use as bearings, face seals, thrust washers, etc., and more generally for a wide variety of applications involving exposure to wear for which conventional types of aluminum articles are unsuitable.

While, as indicated, sintering times of about 15 to about 60 minutes are satisfactory for the practice of the invention, i.e. at a sintering temperature of about 530° to about 590° C (preferably about 550° to about 570° C), very short sintering times can result in under-sintering and excessively long sintering times can result in over-sintering with consequent failure to achieve the desired controlled degree of diffusion of the additive particles. A presently preferred range of sintering times is between about 20 and about 40 minutes. Within the range of suitable sintering times, desired properties such as strength can be optimized for particular applications by selecting the specific time employed. It may be noted that within this time range, development of desired water resistance varies little with change in sintering time, but wear resistance is impaired or lost by over-sintering owing to disappearance of the hard cores or particles of additives which impart that property to the product.

By way of further illustration of the invention, reference may be made to the following specific examples, wherein the additives and/or premixes used are identified by the commerical designations set forth above:

EXAMPLE I

A series of sintered articles were prepared from "MD 22" aluminum premix powder with and without addition of "Tribaloy 400" alloy powder thereto. In each case, the aluminum premix powder contained 1.5 parts by weight of lubricant per 100 parts by weight of metal powder. Also, in each case the powder mixture was compacted to 95% of theoretical density, and the compacted material was sintered in an atmosphere of dry $N_2$ (−45° F dew point). The dimensional change during sintering, and transverse rupture strength of each sintered sample, were determined. In addition, each sintered sample was subjected to a generally conventional Alpha wear test (block and ring) for one hour with a 180-lb. load and a speed of 26 ft/min., using Stoddard solvent and water as lubricants.

The first two samples (A-1 and A-2) consisted of "MD 22" premix powder without addition of any "Tribaloy 400" powder. Compacting pressure required was 20.0 tons/in.$^2$ Sample A-1 was sintered at 625° C while sample A-2 was sintered at 560° C, both for 30 minutes.

Samples B-1, B-2, B-3, and B-4 were made from mixtures of 90% by volume "MD 22" powder and 10% by volume "Tribaloy 400" powder. Compacting pressure required (to attain 95% of theoretical density) was 25.6 tons/in.$^2$ All four samples were sintered at 560° C. Sintering times were as follows: B-1, 20 minutes; B-2, 30 minutes; B-3, 40 minutes; B-4, 50 minutes.

Samples C-1, C-2, C-3, and C-4 were made from mixtures of 80% by volume "MD 22" powder and 20% by volume "Tribaloy 400" powder. The compacting pressures required was 36.4 tons/in.$^2$ The four samples were sintered (all at 560° C) for the following times: C-1, 20 minutes; C-2, 30 minutes; C-3, 40 minutes; C-4, 50 minutes.

Properties of the sintered samples were as follows:

| Sample No. | Dimensional Change (in./ton.) | Transverse Rupture Strength(psi) | Alpha wear test results** Stoddard Solvent | Alpha wear test results** Water |
|---|---|---|---|---|
| A-1 | + 0.007 | 44,200 | Fair | Poor |
| A-2 | + 0.005 | 17,090 | | |
| B-1 | + 0.011 | 20,100 | Excellent | Fair |
| B-2 | + 0.010 | 24,450 | | |
| B-3 | + 0.010 | 33,100 | Excellent | Fair |
| B-4 | distorted* | 13,100* | | |
| C-1 | + 0.011 | 13,900 | Excellent | Good |
| C-2 | + 0.012 | 15,050 | | |
| C-3 | + 0.012 | 17,000 | Excellent | Good |

-continued

| Sample No. | Dimensional Change (in./ton.) | Transverse Rupture Strength(psi) | Alpha wear test results** Stoddard Solvent | Water |
|---|---|---|---|---|
| C-4 | distorted* | 9,000* | | |

*Samples B-4 and C-4 were weak, distorted and discolored.
**Ratings based on examination of the block and ring surfaces at 20× magnification after test:

| | | |
|---|---|---|
| Excellent | = | minor score marks; no surface damage; no galling |
| Good | = | some score marks; no surface damage; no galling |
| Fair | = | weight loss over 10 mg or much scoring; no galling |
| Poor | = | any visible galling or microcracking. |

EXAMPLE II

A further series of samples was prepared by mixing separate quantities of "MD 22" powder with "Tribaloy 100," "Tribaloy 700," and "Tribaloy 800" powders, the amount of the "Tribaloy" powder present in each mixture being 10% by volume. The mixtures were compacted to 95% of theoretical density and sintered for 30 minutes in a dry nitrogen atmosphere (−40° F dew point).

Samples of "MD 22" powder with each of the "Tribaloy" powders (including a sample of 90 vol. % "MD 22" powder and 10 vol. % "Tribaloy 400" powder) sintered at 625° C by this procedure were all weak, distorted, and discolored.

Results at a sintering temperature of 570° C were as follows:

| Additive | Transverse Rupture Strength (p.s.i.) |
|---|---|
| Tribaloy 100 | 22,300 |
| Tribaloy 700 | 23,590 |
| Tribaloy 800 | 21,760 |

EXAMPLE III

Samples of "MD 24," "MD 69," and "MD 76" aluminum premix powders were each mixed with "Tribaloy 400" powder in proportions of 90 vol. % aluminum premix powder to 10 vol. % "Tribaloy 400" powder, compacted, and sintered for 30 minutes (at the temperatures indicated below) by the procedure of Example II above. Results were as follows:

| Premix | Sintering Temp.(° C) | Transverse Rupture Strength (p.s.i.) |
|---|---|---|
| MD 24 | 560 | 26,220 |
| MD 69 | 570 | 22,540 |
| MD 76 | 550 | 17,090 |

In each of Examples II and III, the strength of the samples sintered at low temperatures could be increased to a value approaching 30,000 p.s.i. by increasing the sintering time as in the case of Example I (sample B-3).

Conventional or optimum sintering temperatures for MD 24, MD 69, and MD 76 (when sintered without additive) are respectively 596°, 621°, and 596° C.

EXAMPLE IV

To illustrate the effect of magnesium on attainment of high strength, a series of aluminum premixes were prepared. Samples of each were mixed with "Tribaloy 400" powder (in a proportion of 10 vol. % "Tribaloy 400" powder to 90% aluminum premix), compacted, and sintered for 30 minutes. Premix compositions, optimum sintering temperatures, and transverse rupture strengths of the resultant sintered articles were as follows:

| Premix Composition (% by weight; balance aluminum) | Optimum Sintering Temp. (° C) | Transverse Rupture Strength (p.s.i.) |
|---|---|---|
| 2% Cu | 575 | 4,125 |
| 1% Mg | 580 | 27,390 |
| 0.6% Si | 590 | 3,770 |
| 2% Cu + 1% Mg | 565 | 23,950 |
| 2% Cu + 0.6% Si | 580 | 5,880 |
| 1% Mg + 0.6% Si | 580 | 34,360 |

In every instance, the transverse rupture strength of the sintered articles containing magnesium was far higher than that of articles of otherwise similar composition lacking magnesium.

EXAMPLE V

To further illustrate the relation between magensium content and transverse rupture strength of the sintered article, a series of Al-Mg premix powders were prepared, mixed with "Tribaloy 400" powder in the same 90:10 proportion by volume as in Example IV, and compacted and sintered for 30 minutes. Results were as follows:

| Premix Composition (% Mg by weight; balance aluminum | Optimum Sintering Temp.(° C) | Transverse Rupture Strength (p.s.i.) |
|---|---|---|
| 0.1 % | 585 | 2,535 |
| 0.25 | 585 | 5,255 |
| 0.50 | 580 | 13,915 |
| 1.0 | 580 | 27,390 |
| 2.0 | 570 | 20,785 |
| 5.0 | 560 | 5,790 |

EXAMPLE VI

Pure aluminum powder mixed with "Tribaloy 400" powder in a proportion of 90:10 (parts by volume), and compacted and sintered for 30 minutes by the procedure of Example II, achieved a maximum transverse rupture strength of 9,290 p.s.i. at a sintering temperature of 625° C, remaining unsintered at 625° C and becoming over-sintered at 630° C.

The pure aluminum-"Tribaloy" powder product represents a special case as it is a relatively low-strength product having limited potential application where strength is not critical. The low strength developed, and the narrow temperature range for satisfactory sintering, indicate the importance of the alloying element or elements in the aluminum premix powder for optimum practice of the present invention. Also, the sintering temperature required when pure aluminum is used is much higher than the optimum range for the case of premixes containing alloying elements in addition to "Tribaloy" powder. However, the sintering temperature for the 90:10 mixture of pure aluminum powder and "Tribaloy 400" powder is again much lower than the sintering temperature (~ 655° C) required for pure aluminum alone.

Stated generally, the sintering temperature (for sintering a mixture of any particular aluminum premix with the additive) in accordance with the invention is at least about 25° C (e.g. about 30°–50° C) lower than the conventional or optimum sintering temperature used for the same aluminum premix, i.e. when sintered without the additive present.

It is to be understood that the invention is not limited to the procedures and embodiments hereinabove specifically set forth, but may be carried out in other ways without departure from its spirit.

I claim:

1. A method of producing a sintered metal article comprising:

a. intimately mixing a major proportion of an aluminum premix powder with a minor proportion of particles of an alloy, of a metal selected from the class consisting of cobalt and nickel, having a hard intermetallic Laves phase present in a matrix softer than the Laves phase, said minor proportion being effective to impart wear resistance to the produced article; and b. sintering the resultant mixture at a temperature for effecting controlled diffusion of said particles such that the particles are strongly bonded to metal of the premix powder while remaining as discrete hard cores distributed through the sintered article, thereby to produce a structurally integral, wear-resistant article.

2. A method according to claim 1, wherein the sintering step comprises sintering the mixture at a temperature between about 530° and about 590° C.

3. A method according to claim 1, wherein the mixing step comprises mixing, with said premix powder, a minor proportion of particles of an alloy as aforesaid, having said Laves phase present in a proportion of at least about 30% by volume.

4. A method according to claim 3, wherein said alloy contains molybdenum and silicon as principal alloying elements.

5. A method according to claim 3, wherein said minor proportion is between about 5% and about 25% by volume.

6. A method according to claim 3, wherein said premix powder contains a major proportion of aluminum and at least one alloying element having high solubility therewith, the content of alloying elements in said premix powder being at least about 1% by weight.

7. A method of producing a sintered metal article comprising:

a. intimately mixing i. a major proportion of an aluminum premix powder containing a major proportion of aluminum and a minor proportion of magensium with ii. a minor proportion of particles of an alloy, of a metal selected from the class consisting of cobalt and nickel and containing molybdenum and silicon as principal alloying elements, having a hard intermetallic Laves phase present in a proportion of at least about 30% by volume in a matrix softer than said Laves phase, said minor proportion of particles being between about 5 and about 25% by volume of the resultant mixture of premix powder and said particles of said alloy; and b. sintering the resultant mixture at a temperature between about 530° and about 590° C for producing a strong, structurally integral, wear-resistant article by effecting controlled diffusion of said particles such that the particles are bonded to metal of the premix powder while remaining as discrete hard cores distributed through the sintered article.

8. A method according to claim 7, wherein the sintering step comprises sintering the mixture at a temperature between about 550° and about 580° C.

9. A method according to claim 7, wherein the mixing step comprises mixing, with said premix powder, a minor proportion of particles of an alloy as aforesaid which further contains chromium as an alloying element.

10. A method according to claim 7, wherein said last-mentioned minor proportion is between about 10 and about 20% by volume of the resultant mixture of premix powder and said particles of said alloy.

11. A method according to claim 7, including the step of compacting the mixture of premix powder and said particles of said alloy before sintering, and wherein the sintering step comprises sintering for a period of about 15 to about 60 minutes.

12. A method according to claim 7, wherein said premix powder contains between about 0.5 and about 2.5% by weight magnesium.

13. A method according to claim 12, wherein said premix powder contains between about 0.5 and about 2.0% by weight magnesium.

14. A method according to claim 12, wherein said premix powder consists essentially of about 0.25 to about 4.4% by weight Cu, about 0.5 to about 2.5% by weight Mg, up to about 0.9% by weight Si, up to about 0.4% by weight Mn, up to about 0.2% by weight Cr, up to about 5.6% by weight Zn, and about 90.1 to about 98.05% by weight Al.

15. A method according to claim 7, wherein said alloy consists essentially of about 50 to about 62% by weight of a metal selected from the class consisting of Co and Ni, about 28 to about 35% by weight Mo, about 2 to about 10% by weight Si, up to about 17% by weight Cr, and wherein said Laves phase is present in a proportion of about 65% by volume.

16. A method of producing a sintered metal article comprising:

a. establishing an intimate mixture consisting essentially of i. about 75 to about 95% by volume of an aluminum premix powder comprising at least about 90% by weight Al and about 0.5 to about 2.5% by weight Mg, and ii. about 5 to about 25% by volume of particles of an alloy consisting essentially of about 50 to about 62% by weight of a metal selected from the class consisting of Co and Ni, about 28 to about 35% by weight Mo, about 2 to about 10% by weight Si, up to about 17% by weight Cr, and having a hard intermetallic Laves phase present in a proportion of about 30 to about 65% by volume in a matrix softer than the Laves phase;

b. compacting said mixture; and c. sintering the compacted mixture for about 15 to about 60 minutes at a temperature between about 530° and about 590° C for producing a strong, structurally integral, wear-resistant article by effecting controlled diffusion of said particles such that the particles are bonded to metal of the premix powder while remaining as discrete hard cores distributed through the sintered article.

17. A method according to claim 16, wherein the sintering step comprises sintering at a temperature of about 550° to about 570° C.

18. A method of producing a sintered metal article, comprising:

a. mixing, with a major proportion of metal powder consisting essentially of aluminum, a minor proportion of particles of an alloy consisting essentially of about 50 to about 62% by weight of a metal selected from the class consisting of Co and Ni, about 28 to about 35% by weight Mo, about 2 to about 10% Si, up to about 17% by weight Cr, and having a hard intermetallic Laves phase present in a proportion of about 30 to about 65% by volume in a matrix softer than the Laves phase, said minor proportion being effective to impart wear resistance to the produced article;

b. compacting the resultant mixture; and c. sintering the compacted mixture at a temperature of about 625° C for producing a structurally integral, wear-resistant article by effecting controlled diffusion of said particles such that the particles are bonded to metal of the premix powder while remaining as discrete hard cores distributed through the sintered article.

19. A sintered, wear-resistant metal article produced by the method of claim 16.

20. A sintered, wear-resistant metal article produced by the method of claim 18.

* * * * *